US005152830A

United States Patent [19]

Kobayashi et al.

[11] Patent Number: 5,152,830

[45] Date of Patent: Oct. 6, 1992

[54] THERMITE PROCESS FOR PRODUCING A METAL OR ALLOY

[75] Inventors: Kenichi Kobayashi, Yamagata; Tatsuhiko Fujinuma, Tokyo, both of Japan

[73] Assignee: Japan Metals & Chemical Co., Ltd., Tokyo, Japan

[21] Appl. No.: 783,250

[22] Filed: Oct. 28, 1991

[30] Foreign Application Priority Data

Apr. 15, 1991 [JP] Japan ..... 3-108263

[51] Int. Cl.[5] ..... C22B 9/00

[52] U.S. Cl. ..... 75/414; 75/959

[58] Field of Search ..... 75/414, 959

[56] References Cited

U.S. PATENT DOCUMENTS 2,253,364 8/1941 Cohen ..... 75/959
2,778,723 1/1957 Ujike ..... 75/959
2,836,488 5/1958 Martin ..... 75/959
3,736,127 5/1973 Kocks ..... 75/414

*Primary Examiner*—Peter D. Rosenberg
*Attorney, Agent, or Firm*—Oliff & Berridge

[57] ABSTRACT

A thermite process for producing a pure metal or alloy by charging a reactor furnace with a mixture primarily containing a powdered metallic oxide and a reducing agent such as powdered aluminum, wherein a batch of the mixture of the starting materials is divided into a plurality of loading lots. The amount of heat generated by each of the loading lots of the starting materials is so regulated that the amount of heat generated by each loading lot differs from the amount of heat generated by other loading lots and the loading lots are sequentially arranged. The lots are loaded into a furnace to form layers for thermite reaction in an ascending order of heat generation.

6 Claims, No Drawings

THERMITE PROCESS FOR PRODUCING A METAL OR ALLOY

BACKGROUND OF THE INVENTION

This invention relates to a thermite process for producing a pure metal or alloy metal and, more particularly, it relates to a process for efficiently and effectively producing high quality ferroniobium or metallic chromium by an ingenious technique of charging the furnace with a mixture of starting materials.

A thermite process has long been known as a method of producing a metal or alloy by reducing an oxide of the metal or an ore containing an oxide of the metal by another metal such as aluminum or silicon in a powdered state.

The thermite process can be applied for production of a variety of metals and alloys including metallic chromium ferrovanadium, ferroniobium, ferroboron and other ferroalloys.

When any of these alloys or metals is prepared by a conventional thermite process, the starting metallic oxide or ore containing the metallic oxide is crushed and mixed with a reducing agent such as powdered aluminum, to which a slag forming material, an exothermic agent and/or a cooling agent are added if necessary. The mixture is then put in an appropriate furnace and ignited for thermite reaction. The reaction of the mixed materials proceeds exothermically to produce a metal or alloy and a slag under a fused condition, which are then cooled, solidified and separated from each other to obtain the intended metal or alloy.

For producing a metal or alloy by a known thermite process as described above, it is important to keep the temperature of the fused materials formed at or above 2,000° C. in order to effectively separate the intended metal or alloy from the fused slag. However, since the temperature of the thermite reaction is solely dependent on the heat generated by the exothermic thermite reaction, which can significantly vary as a function of the metal involved, the temperature may be too high or too low depending on the type of the metal or alloy to be produced.

If, for example, the amount of the heat generated by the reaction is too large, the process proceeds too vehemently so as to spatter the raw materials and consequently lower the yield. Besides, it may severely erode the lining of the furnace and the security may be threatened. If, on the other hand, the amount of the heat is too small, the yield will also be lowered because the reaction does not proceed at a satisfactory rate and the resultant metal or alloy may contain some of the slag to deteriorate its quality. If the amount of the generated heat is exceptionally too small, the reaction can terminate while the starting materials are only partly fused.

Therefore, it is essential for a thermite process to ensure an appropriate level of heat value, particularly when a metal or alloy is to be produced on an industrial basis and there have been taken specifically designed measures to meet this requirement. Some of the measures include the following.

(1) For an excessively exothermic reaction, the heat generated in the reaction is suppressed by partly replacing the oxide of the metal in the reaction system with the pure metal. Alternatively, a volume of an undersized material of the metal or alloy to be produced (that simply consumes heat to become fused and does not generate heat) is added to suppress the temperature.

(2) For an insufficiently exothermic reaction, an electric furnace is used to supply additional heat to the reaction system. Alternatively, a mixture of powdered aluminum and an easily decomposable oxide that scarcely consumes heat for decomposition is added to the reaction system as an exothermic agent.

The known ordinary thermite process is conducted on a batch basis. A batch of the starting materials are weighed, mixed and then loaded into a furnace in one lot at a time, the amount of the heat to be generated in the reaction being determined by calculating the average exothermic energy of the batch in the reaction system. Of course, meticulous calculations and preliminary experiments are required for determining the exact amount of the starting materials.

However, such a known process is accompanied by problems as described below. Firstly, according to a close observation by the inventors of the present invention on the metallurgical reaction in a known thermite process conducted on a batch basis, the reaction proceeds very slowly in the initial stages, revealing that a heat-insufficiency condition is there, followed by the intermediary stages where the reaction is suddenly accelerated until an excessively high rate of heat generation emerges. When the thermite reaction proceeds with such a profile, there can be cases where the reaction comes to a stand-still somewhere in the initial stages and those where the starting materials are spattered about to lower the yield in the latter part of the reaction while the lining of the furnace becomes very liable to be eroded. Besides, the reaction can proceed very irregularly with the known process so that the resultant metal or alloy may be of inferior quality.

SUMMARY OF THE INVENTION

It is therefore the object of the present invention to provide a thermite process that can overcome the above described problems of a known process which are attributable to the fact that the process is conducted on a batch basis, and consequently the present invention process can produce a high quality metal or alloy at a high yield.

As a result of intensive research efforts to achieve the above object, the inventors of the present invention came to find a new thermite process with which the heat generated in a thermite reaction can be regulated by appropriately using cooling and exothermic agents at rates that can be controlled at each stage of the metallurgic reaction so that a high quality metal or alloy may be produced at a high yield.

According to the invention, there is provided a thermite process for producing a metal or alloy by charging a reactor furnace with a mixture of a powdered metallic oxide and a reducing agent such as powdered aluminum, wherein a batch of the mixture of the starting materials is divided into a plurality of loading lots in such a manner that the amount of heat generated by each of the loading lots of the starting materials is so regulated that the amount of heat generated by each loading lot differs from the amount of heat generated by any other loading lot and the loading lots are sequentially arranged and loaded into a furnace for thermite reaction in an ascending order of heat generation. The regulation of the heat generation in each of the loading lots of the starting materials is realized by using a stoichiometric mixture of at least one of sodium chlorate, potassium chlorate, potassium perchlorate, sodium nitrate, potassium nitrate, calcium peroxide, barium peroxide and chromate and a reducing agent such as aluminum and by varying the amount of the mixture added to each of the loading lot. Preferably, the powdered metallic oxide is chromium oxide or iron oxide for metallic chromium and niobium oxide for ferroniobium.

DESCRIPTION OF THE PREFERRED EMBODIMENTS

In the following, the present invention will be described in greater detail by way of examples.

The reaction for producing metallic chromium from, for instance, chromium (III) oxide ($Cr_2O_3$) and aluminum (Al) by way of a thermite process will be expressed by the following formula.

$$Cr_2O_3+2Al=2Cr+Al_2O_3 \quad [1]$$

According to the above formula, the aluminum oxide ($Al_2O_3$) corresponding to the amount of metallic chromium is produced.

When the starting materials are compounded for a thermite reaction for producing a metal or alloy by using aluminum as a reducing agent, the amount of aluminum to be charged is a function of the kind and the composition of the metal or alloy to be produced. For instance, if the metal or alloy to be produced contains aluminum to some extent, the amount of aluminum to be used is made somewhat larger than the stoichiometric quantity determined by the applicable chemical formula in order to improve the yield. This is a way normally applied for producing ferroalloys. If, on the other hand, the metal to be produced should be free from aluminum as much as possible, as in the case of metallic chromium, the amount of aluminum to be used is made somewhat smaller than the stoichiometric quantity so that the aluminum may be entirely converted into aluminum oxide. This is a way that has long been practiced in the production of metallic chromium and there are a number of papers on this theme. For instance, "ANNALI DI CHIMICA" 77-81, Vol. 41 (1991), "Rassian Metallurgy and Mining" 20-26, No. 1 (1963), "Ullmanns Encyklopadie der Technischen Chemie" Band 9, 591, (1975) etc.

According to these papers, the amount of aluminum to be used is normally less than the stoichiometric quantity by 5 to 20 percent.

When the amount of aluminum to be used is smaller than the stoichiometric quantity, some of the chromium (III) oxide charged into the furnace is inevitably left unaffected in the reaction system after completion of the reaction to form slag with aluminum oxide, which is the principal component of the slag. If, for instance, the amount of aluminum charged into the furnace is 90% of the stoichiometric quantity, the produced slag will contain about 85% of $Al_2O_3$ and about 15% of $Cr_2O_3$. While the slag to metallic chromium ratio will be substantially equal to one (1) when aluminum is used by a stoichiometric quantity, it will become greater as the amount of aluminum is reduced in the reaction system because the amount of $Cr_2O_3$ which is left unaffected is increased and the amount of metallic chromium produced goes down, making the slag to metallic chromium ratio consequently go up. If the amount of aluminum is 90% of the stoichiometric quantity, the slag to chromium ratio will be 1.15.

Molten metallic chromium and slag containing mainly $Al_2O_3$ are simultaneously produced in a mixed state as the reaction proceeds and then separated from each other by the difference of specific gravity. Separation of metallic chromium and slag should be conducted quickly and as soon as possible after the production of a mixture of metallic chromium and slag in order to obtain the metallic chromium of high purity concentration.

For effective separation of metallic chromium and slag, temperature plays the most important role. If the generation of heat is small and the temperature is low, the slag will not be satisfactorily separated from the metallic chromium. On the other hand, the reaction violently proceeds within a short period of time if a high heating value is involved so that some of the produced molten metal can precipitate in the reaction furnace and is cooled and solidified there before it is satisfactorily separated from the slag while the starting materials may partly remain unaffected because the reaction time is too short. In order to complete the reaction and effectively separate the produced metal or alloy from the slag, two contradictory requirements of a high temperature for completion of reaction and a long reaction time for effective separation of metal and slag should be simultaneously met. These requirements can be met only through elaborate control of heat generation.

If the process of thermite reaction for producing a metal or alloy is carefully observed, it will be understood that the reaction proceeds in the furnace in the following manner.

After loading the starting materials into a reaction furnace, a thermite reaction is started by igniting the top of the materials (e.g., a mixture of a powdered metallic oxide and powdered aluminum) loaded in the furnace. The materials are gradually fused by the heat generated in the exothermic thermite reaction to become a molten slag, which heat the starting materials in the neighboring area to cause them to react with each other. The reaction proceeds in this way until all the materials are consumed, when the reaction finally terminates. Since the quantity of the molten slag is relatively small and that of the materials left for future reaction is large in the initial stages, heat is always in short supply for the reaction system in those stages, to make the reaction proceed slowly. In other words, the thermite reaction proceeds only along the interface of the loaded starting materials and the molten slag, and the interface gradually goes down. When the reaction has advanced to a certain degree and the interface of the loaded starting materials and the molten slag has a relatively large area while it stores a considerable amount of heat in it, the reaction can become very vehement. However, such as uneven progress of reaction is not desirable for maintaining a desirable temperature and achieving a good separation of the metal and slag. Theoretically, any undesirable condition of generating heat may be checked by regulating the rate of heat generation in every stage of the reaction. However, an attempt to constantly regulate the rate of heat generation in the reaction system will not be successful because of the high temperature of the molten slag, which is somewhere around 2,000° C. One possible method of regulating the rate of heat generation may be preparing a small amount of molten slag in the reactor furnace and gradually introducing a corresponding amount of the starting materials into the furnace. However, this method is not feasible because the materials placed on the slag is vehemently spattered about to seriously lower the yield of the final product.

In view of these circumstances and as a result of intensive research efforts, the inventors of the present invention came to find that the above described problems can be effectively solved by dividing a batch of a mixture of the starting materials into several loading lots in such a manner that the amount of heat generated by each of the lots is different from those of the other lots and loading the lots sequentially into the furnace in an ascending order in terms of the level of heat generation. With such an arrangement of preparing a plurality of loading lots out of a batch of starting materials for regulating the heat generated in a thermite reaction, the above described problems are effectively solved.

A metallic oxide may be used as one of the primary starting materials, if the intended product is metallic chromium or a ferroalloy, iron oxide, chromium oxide, manganese oxide, niobium oxide, vanadium oxide, molybdenum oxide, boron oxide, titanium oxide, tungsten oxide or an one containing any of these. When the material is supplied in the form of blocks, they should be crushed in advance to granules of an appropriate size, preferably 100 mesh or less. If the size of the particles is too large, the reduction by aluminum does not proceed at a sufficient rate and a prolonged reaction time can result in an insufficient supply of heat and a low yield of the intended metal or alloy.

Aluminum to be used as a reducing agent is normally supplied in the form of granules, flakes or needle-shaped pieces having a size of approximately 3 mm. Aluminum may be partly replaced by another reducing agent such as silicon, calcium or magnesium.

According to the invention, a slag forming material is used as an auxiliary starting material which is added to said primary starting materials. When a metallic oxide and aluminum are mixed and put to thermite reaction in a furnace, the reaction products in the furnace will be the metal or alloy and a slag almost entirely consisted of alumina. Since alumina melts only at very high temperature, measures should be taken to lower the melting point for the purpose of the thermite reaction and the slag forming material is used exactly to lower the melting point of the slag. The slag forming material according to the invention will be quick lime, fluorite, magnesia or any other appropriate material.

A cooling agent may be used to regulate the rate of heat generation. Such a cooling agent should not interfere with the thermite reaction but should simply melt to absorb excessive heat in the reaction system. Normally, sieved particles of the intended metal or alloy will be used as they may be advantageously remelted. Since the slag forming material used for the reaction system does not interfere with the thermite reaction either, it may also act as a cooling agent.

Another auxiliary material will be an exothermic agent. This is a material to be used when the rate of heat generation in the reaction system is too low and normally a stoichiometric mixture of an oxygen supplying material and alumina. In most cases, the oxygen supplying material will be a peroxide. It should not affect the quality of the intended metal or alloy and the chemical properties of the slag and may be preferably selected from sodium chlorate, potassium chlorate, sodium perchlorate, potassium perchlorate, sodium nitrate, potassium nitrate, calcium peroxide and barium peroxide. Chromates may also be suitably used when the intended metal or alloy is metallic chromium or a chromium alloy.

As described earlier, a thermite process according to the present invention is characterized in that the above mentioned starting materials are mixed to form a batch, which is divided into a plurality of loading lots in such a manner that an amount of heat generated by each of the loading lots of the starting materials differs from the amount of heat generated by any other loading lot. For instance, a batch of a metal oxide to be subjected to thermite reaction may have a weight of 1,000 kg and it may be divided into four lots, each weighting 250 kg, although the amount of heat each of the lots generates differs from the amount of heat generated by any other loading lot and is so adjusted as to best fit the location in the furnace where it is loaded.

The amount of heat to be generated by each of the lots of the mixture of the primary starting materials is regulated by determining the amount of the slag forming material and that of the cooling material to be added to the mixture of the metallic oxide and aluminum having a predetermined weight. The amount of an exothermic agent, e.g., a stoichiometry mixture of sodium chlorate and aluminum, to be added to the mixture of the primary starting materials is further determined so that the amount of heat generated by the lot of the final mixture exactly meets the requirement of heat generation which is a function of the location of the furnace where the lot is loaded.

The total amount of heat required to carry out the thermite reaction of a batch solely depends on the type of the intended metal or alloy. In the case of producing ferroniobium starting from niobium oxide are and iron oxide, the heat requirement will be approximately 600 kcal/kg. For producing metallic chromium from chromium (III) oxide, the required rate of heat supply will be about 720 kcal/kg. For producing ferrovanadium from vanadium pentaoxide and iron oxide, heat will need to be supplied at a rate of about 650 kcal/kg, whereas, in the case of producing ferromolybdenum from molybdenum trioxide and iron oxide, the rate will be about 560 kcal/kg.

On the other hand, the amount of heat required to carry out the thermite reaction of each of the lots obtained by dividing a batch is a function of the type of the intended metal or alloy, the particle size of each of the starting materials, the profile of the furnace to be used, the amount of the batch and other variables. Therefore, the rate of addition of an exothermic agent should be exactly determined through experiments. According to the result of a research conducted by the inventors of the present invention, the amount of heat generation of a first lot of a batch for producing ferroniobium always fall short of heat, although there is supplementary supply of heat by an exothermic agent (See Table 2 in Example 1).

The lots of a batch obtained by weighing and mixing the starting materials are then sequentially loaded into the reactor furnace in an ascending order in terms of the level of heat generation. The reactor furnace may be of any appropriate profile, although a standing cylindrical furnace is preferable as the lots are loaded in so many layers and, therefore, the furnace should have a limited horizontal sectional area. Most preferably, when a batch of the starting materials is completely loaded into the furnace, it shows a height/diameter ratio of 1 to 1.5.

After the total loading lots of the starting materials is loaded into the reactor furnace, it is ignited for thermite reaction. While the time required for the reaction to complete depends on the type of the intended metal or alloy, it is desirable that the reaction proceeds at a constant rate. If any fluctuation in the rate of reaction is observed in any stage of the reaction, the rate of heat generation should be regulated by the next batch to be loaded into the furnace.

After completion of the reaction, the fused metal or alloy and the slag are separated from each other due to the difference of specific gravity and the former is deposited on the bottom of the reactor furnace. It can be collected after it has been cooled.

With a thermite process according to the invention, since the temperature of the reaction product can be appropriately maintained after the reaction is completed, the obtained fused metal or alloy and the fused slag can be separated from each other very easily and the former is of very high quality as it scarcely contains non-metallic inclusion and other impurities. Moreover, since the starting materials are hardly spattered around, the yield will be exceptionally high.

EXAMPLE 1

Ferroniobium was produced, using niobium ore (niobium oxide) and iron oxide as starting metallic oxides, aluminum as a reducing agent, sodium chlorate as an exothermic agent and a mixture of fluorite and quick lime as a slag forming material. Table 1 shows the composition and the particle size of these materials.

A standing cylindrical reactor furnace having an inner diameter of 1 m and a height of 2 m was used. A batch of the materials contained a 1,000 kg of niobium ore and was divided into three lots. Each of the first and second lots contained a 400 kg of niobium ore, while the remaining portion, or 200 kg, of the niobium ore, was contained in the third lot. Each of the other component materials was also divided into three portions and the materials were mixed together for each lot with such a ratio that each of the lots would generate an intended amount of heat. The ratio of the component materials and the rate of heat generation for each of the three lots are shown in Table 2.

For thermite reaction, the first lot was loaded into the reactor furnace and the second lot was placed on the first lot, the third lot being subsequently placed on the second lot. The top of the load was ignited to trigger a thermite reaction. The reaction went on evenly until it was terminated twelve minutes after the start of the reaction. When the reaction product was cooled, the slag found on the upper portion of the product was removed and the ferroniobium, remained in the furnace was collected.

TABLE 1

| | Composition (%) | | | | | | Particle size |
|---|---|---|---|---|---|---|---|
| | $Nb_2O_5$ | $Ta_2O_5$ | FeO | $SiO_2$ | CaO | $CaF_2$ | (mm) |
| niobium ore | 60.1 | 0.4 | 5.2 | 2.9 | 12.9 | — | 0.15 or less |
| iron oxide | — | — | 73.0 | — | — | — | 10 or less |
| quick lime | — | — | — | — | 94.0 | — | 10 or less |
| fluorite | — | — | — | 0.8 | — | 96.0 | 5 or less |
| aluminum | Al: 97.3 | | | | | | 3 or less |
| sodium chlorate | $NaClO_3$: 98.0 | | | | | | 1 |

TABLE 1-continued

| | Composition (%) | | | | | | Particle size |
|---|---|---|---|---|---|---|---|
| | $Nb_2O_5$ | $Ta_2O_5$ | FeO | $SiO_2$ | CaO | $CaF_2$ | (mm) |
| chlorate | | | | | | | or less |

TABLE 2

| | 1st lot | 2nd lot | 3rd lot | total |
|---|---|---|---|---|
| niobium ore (kg) | 400 | 400 | 200 | 1000 |
| iron oxide (kg) | 65 | 65 | 32 | 162 |
| aluminum (kg) | 60 | 160 | 130 | 350 |
| sodium chlorate (kg) | 17 | 20 | 13 | 50 |
| quick lime (kg) | 28 | 28 | 4 | 60 |
| fluorite (kg) | 35 | 32 | 13 | 80 |
| undersized ferroniobium (kg) | 25 | 25 | — | 50 |
| total (kg) | 630 | 730 | 392 | 1752 |
| amount of heat generation (kcal/kg) | Δ206 | 760 | 1590 | 600 |

Table 3 shows the composition of the resultant ferroniobium and the niobium yield in the reaction. As apparent from the table, a high niobium yield of 97% was achieved. It was also proved that the slag forming the upper layer of the product of a thermite process according to the invention could be easily removed and the obtained ferroniobium showed a very smooth surface.

For comparison, the composition of the produced ferroniobium and the niobium yield in an experiment conducted by using a known thermite process are also shown in Table 3. A 1,000 kg of niobium ore was used to prepare a batch of a mixture of starting materials (the contents being exactly same as those shown in the total column in Table 2), which was loaded at a time into a reactor furnace for thermite reaction. While the reaction was terminated five minutes after the start of the reaction, it went on very gradually in the initial stages and, after a few minutes, was accelerated vehemently, fiercely spattering the materials to threaten the security of the operation. The slag was less easily separated from the ferroniobium produce than that of the experiment conducted by way of a process according to the invention.

TABLE 3

| | produced ferroniobium (kg) | composition (%) | | | | (Nb + Ta) yield (%) |
|---|---|---|---|---|---|---|
| | | NB + Ta | Al | Si | Fe | |
| present invention | | | | | | |
| 1 | 649 | 68.1 | 1.3 | 2.1 | bal. | 97.2 |
| 2 | 651 | 67.9 | 1.4 | 2.2 | bal. | 97.1 |
| 3 | 645 | 68.3 | 1.0 | 2.0 | bal. | 96.8 |
| comparison | | | | | | |
| 4 | 611 | 66.7 | 1.4 | 2.5 | bal. | 89.6 |
| 5 | 624 | 66.9 | 1.3 | 2.6 | bal. | 91.8 |

EXAMPLE 2

Metallic chromium was produced, using chromium oxide (purity: 99.9% in terms of $Cr_2O_3$) as a starting metal oxide, aluminum (purity: 99.9%, particle size: 1 mm or less) as a reducing agent, sodium chlorate (powder) as an exothermic agent.

A batch containing chromium oxide by 1,000 kg was divided into four lots, whose contents are shown in Table 4, which also shows the calculated amount of heat generation for each lot.

TABLE 4

| | 1st lot | 2nd lot | 3rd lot | 4th lot | total |
|---|---|---|---|---|---|
| chromium oxide (kg) | 250 | 250 | 250 | 250 | 1000 |
| sodium chlorate (kg) | 16.6 | 20.5 | 21.0 | 24.9 | 83 |
| aluminum (kg) | 86.9 | 88.5 | 89.5 | 91.1 | 356 |
| total (kg) | 353.5 | 359.0 | 360.5 | 366.0 | 1439 |
| amount of heat generation (kcal/kg) | 685 | 715 | 723 | 751 | 719 |

For thermite reaction, a reactor furnace similar to the one used in Example 1 was used and the four lots were sequentially loaded into the reactor furnace to form so may layers. The top of the load was ignited to trigger a thermite reaction. The reaction went on evenly until it was terminated three minutes after the start of the reaction. When the reaction product was cooled, the slag found on the upper portion of the product was removed and the metallic chromium, remained in the furnace was collected. It was also proved that the slag forming the upper layer of the product could be easily removed.

For comparison, a batch whose composition was exactly the same as that of the above examples was loaded at one time into a reactor furnace for thermite reaction. While the reaction was terminated fifty seconds after the start of the reaction, it went on very gradually in the initial stages and, after tens of seconds, was accelerated vehemently, fiercely spattering the materials. The slag was less easily separated from the metallic chromium product than when the experiment was conducted by way of a process according to the invention and the metallic chromium product contained slag to a considerable extent.

Table 5 shows the purity of the resultant metallic chromium and the chromium yield of Example 2 as well as those of the experiment conducted for comparison. It is clearly shown that a process according to the present invention can produce a higher purity and a higher yield than a known method.

TABLE 5

| | produced metallic chromium (kg) | composition (%) | | | | | | | Cr yield (%) |
|---|---|---|---|---|---|---|---|---|---|
| | | Cr | Fe | Si | Al | Cu | C | S | |
| the present invention | (1) 575.6 | 99.93 | 0.0215 | 0.0065 | 0.0150 | 0.0010 | 0.0034 | 0.0216 | 84.1 |
| | (2) 574.9 | 99.93 | 0.0235 | 0.0058 | 0.0098 | 0.0010 | 0.0053 | 0.0232 | 84.0 |
| comparison | 558.2 | 99.91 | 0.0230 | 0.0062 | 0.0318 | 0.0010 | 0.0042 | 0.0254 | 81.6 |

EFFECTS

As is apparent from the above description, a thermite process for producing a metal or alloy according to the invention ensures an even progress of thermite reaction throughout the process, eliminating any unintended halt or excessive progress of reaction. Consequently, it ensures a high purity as well as a high yield for metal or alloy production.

What is claimed is:

1. A thermite process for producing a pure metal or alloy metal by a thermite reaction after charging a reactor furnace with a mixture of a powdered metallic oxide and a reducing agent, the process comprising the steps of:

dividing a batch of the mixture into a plurality of loading lots such that an amount of heat generated by each loading lot of the plurality of loading lots is regulated to produce a different predetermined amount of heat for each respective loading lot, and loading each loading lot sequentially into the reactor furnace for thermite reaction in an ascending order of heat generation.

2. A process according to claim 1, wherein said step of dividing comprises varying a composition of each loading lot so that the regulation of the heat generated in each of the loading lots is based on a stoichiometric mixture of at least one of sodium chlorate, potassium chlorate, potassium perchlorate, sodium nitrate, potassium nitrate, calcium peroxide, barium peroxide and chromate and a reducing agent.

3. A process according to claim 1, wherein the powdered metallic oxide is chromium (III) oxide.

4. A process according to claim 1, wherein the powdered metallic oxide is a mixture of niobium oxide and iron oxide.

5. A process according to claim 2, wherein the reducing agent is aluminum.

6. A process according to claim 1 further comprising a step of externally heating the reactor furnace.

* * * * *